United States Patent [19]

Matsui et al.

[11] Patent Number: 4,571,124

[45] Date of Patent: Feb. 18, 1986

[54] METHOD OF FORMING CAST-IN-PLACE CONCRETE PILE

[75] Inventors: Ichiro Matsui; Hiroaki Kobayashi, both of Tokyo; Hideo Sano, Yokosuka, all of Japan

[73] Assignee: Sumitomo Cement Co., Ltd., Tokyo, Japan

[21] Appl. No.: 553,294

[22] Filed: Nov. 18, 1983

[30] Foreign Application Priority Data

Nov. 18, 1982 [JP] Japan ..... 57-201048

[51] Int. Cl.[4] ..... E02D 5/34

[52] U.S. Cl. ..... 405/239; 405/234

[58] Field of Search ..... 405/233, 234, 239, 256, 405/257

[56] References Cited

U.S. PATENT DOCUMENTS 1,106,606 8/1914 Wilhelmi ..... 405/234

FOREIGN PATENT DOCUMENTS 656916 4/1965 Belgium ..... 405/234

*Primary Examiner*—David H. Corbin

*Attorney, Agent, or Firm*—Cushman, Darby & Cushman

[57] ABSTRACT

There is disclosed a method of forming a cast-in-place concrete pile. A demolition-facilitating substance is mounted in an open top confined space above a predetermined level. The demolition-facilitating substance is expansible upon lapse of a predetermined period of time. Concrete is poured into the confined space to cover the demolition-facilitating substance to cast a concrete pile, so that the demolition-facilitating substance is expanded to produce cracks in the concrete pile above the predetermined level.

3 Claims, 6 Drawing Figures

METHOD OF FORMING CAST-IN-PLACE CONCRETE PILE

BACKGROUND OF THE INVENTION

1. Field of the Invention

This invention relates generally to a method of forming a cast-in-place concrete pile and particularly to a method of demolishing or removing an upper end of such a concrete pile.

2. Prior Art

In the construction of structures such as a building and a bridge, cast-in-place concrete piles have been extensively used for building foundations. The cast-in-place concrete pile is formed by boring a hole in the ground and pouring concrete into the hole. Such a hole is, for example, formed using an earth auger. Usually, a suitable liquid such as a bentonite solution is filled in the hole to prevent the wall of the hole from crumbling, and a shell or tube of a thin steel sheet is fitted in the hole. Then, a reinforcement of a latticework is inserted into the hole, and concrete is poured into the hole through a tremie pipe to replace the above-mentioned liquid, thereby casting a concrete pile. The shell is then withdrawn from the ground. Finally, the upper portion of the cast concrete pile is removed or demolished by a suitable demolition means such as a hammer to provide the finish concrete pile of a predetermined height.

The upper portion of the cast concrete pile is removed because the upper portion has a poor quality. More specifically, a small amount of soil or the like is deposited on the bottom of the hole in which the liquid such as a bentonite solution is filled. When concrete is poured into the hole through the tremie pipe, the soil deposited on the bottom of the hole is moved upwardly so that the upper portion of the resultant concrete pile contains the soil and the liquid as impurities. Therefore, the upper portion of such a concrete pile has failed to have a sufficient strength for the building foundation, and such a concrete pile could not be satisfactorily jointed to a footing of the building. Therefore, the upper portion of the cured concrete pile having a poor quality has heretofore been removed or demolished by the use of a breaker or the like after the withdrawal of the shell and the excavation of the ground around the pile. This method has been found disadvantageous, however, from a viewpoint of environmental pollution, since it gives rise to substantial noises and vibrations. In addition, this method has required relatively much time and labor. In order to overcome such difficulties, the use of an expansive demolition-facilitating substance has been recently proposed to efficiently demolish the upper portion of the cast concrete pile. With this method, the upper portion of the concrete pile can be demolished easily in a quiet manner. This conventional method will now be described in more detail with reference to FIGS. 1 and 2.

U-shaped and straight hollow spiral sheathed tubes 11 and 12 are mounted within a shell 13 at its upper portion above a predetermined plane 14 of demolition, the shell 13 being placed in a hole in the ground. The upper portion 15 of the cast concrete pile 16 above the demolition plane 14 is to be removed or demolished. Concrete is poured into the shell 13 beyond the demolition plane to cover the hollow tubes 11 and 12. Then, the shell 13 is withdrawn from the ground, and the ground around the cast concrete pile 16 is subjected to excavation. Then, an expansive demolition-facilitating substance, for example, one manufactured and sold by Sumitomo Semento Kabushiki Kaisha (Japan) under the tradename of S-mite, is filled in the hollow tubes 11 and 12. The demolition-facilitating substance in the hollow tubes 11 and 12 is expanded upon the lapse of a predetermined time so that it ruptures the hollow tubes 11 and 12 and causes cracks in the upper portion 15 of the cast concrete pile 16 to demolish it. The hollow tubes 11 and 12 have such a nature that they will not prevent the expansion of the demolition-facilitating substance.

In this demolishing method, it is important that the concrete pile 16 should not be subjected to demolition or damage below the demolition plane 14. Therefore, the U-shaped hollow tubes 11 and the straight hollow tubes 12 are so arranged that the concrete pile 16 is not subjected to such damage. More specifically, the U-shaped hollow tubes 11 each defined by a pair of arms 11*a* and 11*a* and a base 11*b* interconnecting the arms are arranged in parallel spaced relation with their respective arms 11*a* disposed vertically adjacent to the inner peripheral surface of the shell 13, their bases 11*b* being disposed horizontally and spaced upwardly from the demolition plane 14 a predetermined distance. One or more of the straight hollow tubes 12 are vertically disposed between the arms 11*a* and 11*a* of each of the U-shaped hollow tubes 11. With this arrangement, the arms 11*a* of the U-shaped hollow tubes 11 and the vertical straight hollow tubes 12 both containing the demolition-facilitating substance serve to produce vertical cracks in the upper end 15 of the concrete pile while the horizontal bases 11*b* of the U-shaped hollow tubes 11 containing the demolition-facilitating substance serve to produce horizontal cracks in the upper end 15 of the concrete pile 16.

The base 11*b* of each U-shaped hollow tube 11 can be first filled with the demolition-facilitating substance, and later the arms 11*a* can be filled with this substance. Therefore, the horizontal cracks are first produced in the upper portion 15 of the concrete pile 16, and then the vertical cracks are produced therein. This procedure ensures that the concrete pile 16 is not subjected to cracks below the demolition plane 14.

This conventional method has been found disadvantageous, however, in that the installation of the concrete pile 16 requires much time since the demolition-facilitating substance is filled in the hollow tubes 11 and 12 after the concrete is cured. In addition, the filling of the demolition-facilitating substance into the horizontal bases 11*b* of the U-shaped hollow tubes 11 and the filling of this substance into the vertical arms 11*a* and the vertical straight hollow tubes 12 are carried out separately at different stages. This aggravates the problem of the installation time. Further, since the demolition-facilitating substance is applied to the hollow tubes 11 and 12 after the concrete pile 16 has been cured, foreign matters such as muddy water tend to be introduced into the hollow tubes 11 and 12 during the curing of the concrete. As a result, it is possible that the upper portion 15 of the concrete pile 16 is not demolished satisfactorily. Further, there is a possibility that the hollow tubes 11 and 12 and reinforcement bars are subjected to damage when excavating the ground around the concrete pile 16, so that the demolition-facilitating substance is not filled in the hollow tubes 11 and 12 satisfactorily.

SUMMARY OF THE INVENTION

It is therefore an object of this invention to provide a method of forming a cast-in-place concrete pile in which the demolition of the upper end of the cast concrete pile can be carried out in a shorter period of time.

According to the present invention, there is provided a method of forming a cast-in-place concrete pile which comprises the steps of mounting a demolition-facilitating substance in an open top confined space above a predetermined level, the demolition-facilitating substance being expansible upon the lapse of a predetermined period of time; and pouring concrete into the confined space to cover the demolition-facilitating substance to cast a concrete pile, so that the demolition-facilitating substance is expanded to produce cracks in the concrete pile above the predetermined level.

The demolition-facilitating substance used in this invention is one manufactured and sold by Sumitomo Semento Kabushiki Kaisha (Japan) under the tradename of Special S-mite. The special S-mite comprises calcium alumina ferrite $(CaO)_4.Al_2O_3$. $Fe_2O_3$, free calcium oxide (CaO), and magnesium oxide (MgO) as well as a retarder such as boron. The generation of expansion of the demolition-facilitating substance can suitably coincide with the generation of strength of the cast concrete pile by either varying the amount of the retarder or changing the kind of the retarder. Therefore, the cracks can be produced in the concrete pile by the expansion of the demolition-facilitating substance generally at the time when the curing of the concrete pile is completed. Alternatively, the demolition-facilitating substance can be so adjusted that the cracks are caused to develop gradually during the curing of the concrete pile.

The demolition-facilitating substance (Special S-mite) is provided in the form of powder. 30 wt. % of this demolition-facilitating powder and 70 wt. % of water are mixed together to provide a slurry. Preferably, this slurry is filled in suitable containers such as hollow spiral sheathed tubes. The hollow tubes holding the demolition-facilitating substance are attached to a reinforcement of a latticework. The reinforcement is placed in a hole in the ground, and the hollow tubes holding the demolition-facilitating substance are positioned above a plane of demolition of the resultant concrete pile. Preferably, the hollow tubes are made of thin sheel sheet but may be made of any other suitable material which will not cause the demolition-facilitating slurry to permeate therethrough and will not prevent the expansion of the demolition-facilitating substance so that they can be easily ruptured upon expansion of the demolition-facilitating substance. The hollow tubes are arranged to a desired shape so that the cracks can develop in the concrete pile in desired directions.

DESCRIPTION OF THE PREFERRED EMBODIMENT OF THE INVENTION

Figure 1:
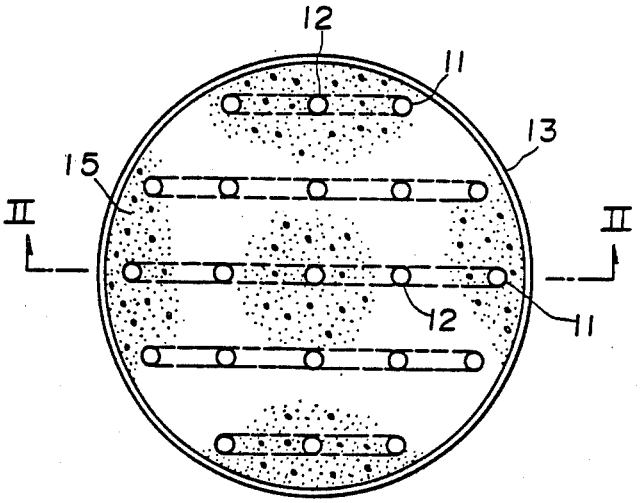
FIG. 1 (PRIOR ART)
FIG. 1 is a plan view of a concrete pile formed by the conventional method.
Figure 2:
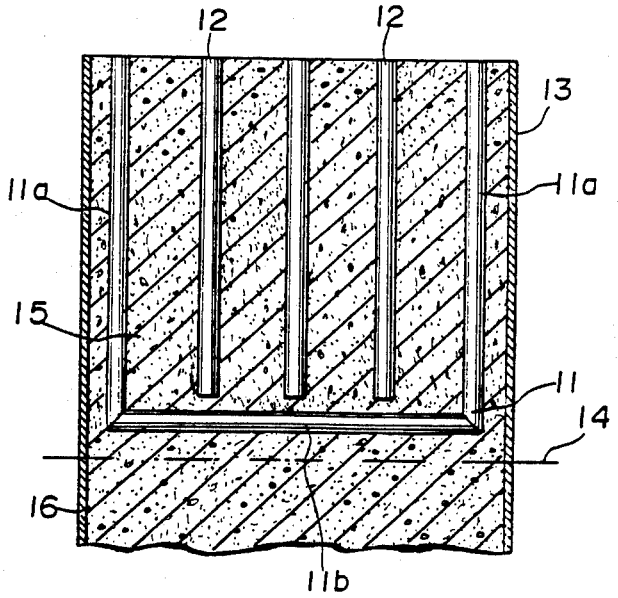
FIG. 2 (PRIOR ART)
FIG. 2 is a cross-sectional view of the concrete pile taken along line II—II of FIG. 1.
Figure 3:
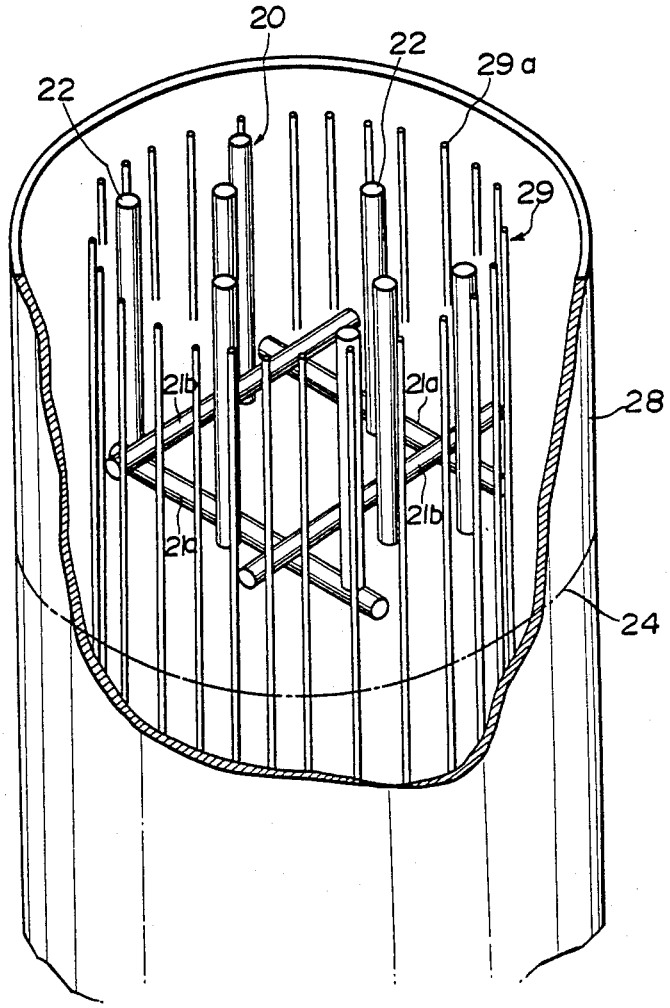
FIG. 3 is a partly-broken perspective view of a concrete pile formed by a method according to the present invention.
Figure 4:
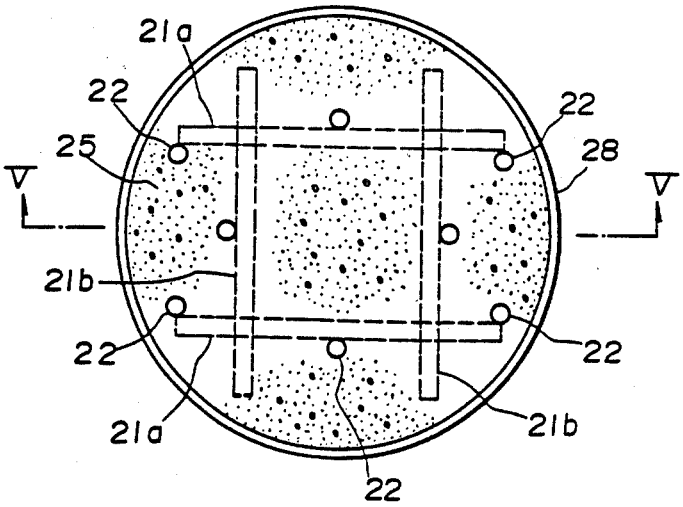
FIG. 4 is a plan view of the concrete pile of FIG. 3.
Figure 5:
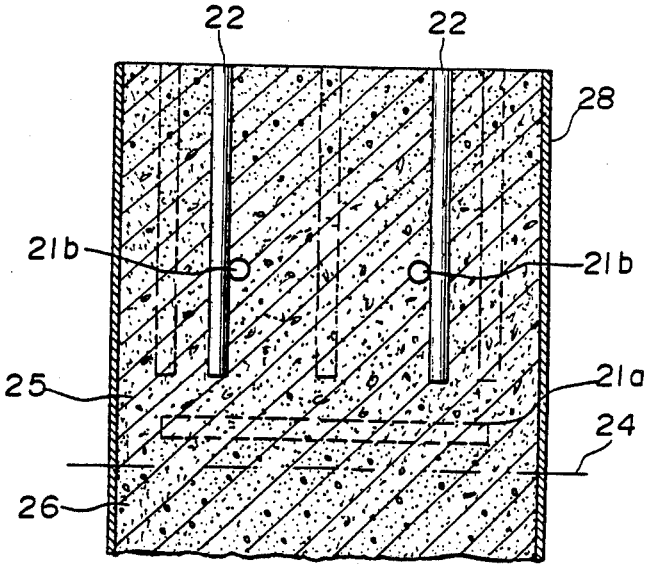
FIG. 5 is a cross-sectional view of the concrete pile taken along the line V—V of FIG. 4.

As shown in FIGS. 3 to 5, a tube structure 20 for holding a demolition-facilitating substance comprises four hollow sheathed tubes 21*a* and 21*b* disposed horizontally and eight vertical hollow spiral tubes 22. Each of the hollow sheathed tubes 21*a*,21*b*,22 is made of a thin steel sheet and has a diameter of about 40 mm. The lower two horizontal hollow tubes 21*a* arranged parallel to each other are disposed about 30 to 40 cm above a predetermined plane 24 of demolition. The upper portion 25 of the concrete pile 26 above the demolition plane 24 is to be demolished or removed. The other two parallel horizontal hollow tubes 21*b* are disposed at a level above the lower horizontal hollow tubes 21*a*. The four horizontal hollow tubes 21*a* and 21*b* are secured at their ends to bars 29*a* of a latticework reinforcement 29 by wires. The eight vertical hollow tubes 22 are disposed above the demolition plane 24, and four of them are disposed adjacent to the respective ends of the two horizontal hollow tubes 21*a* and secured thereto by wires. The other four vertical hollow tubes 22 are disposed adjacent to the four horizontal hollow tubes 21*a* and 21*b* and intermediate the respective opposite ends thereof, and are secured thereto by wires.

The four horizontal hollow tubes 21*a* and 21*b* for containing the demolition-facilitating substance serve to produce generally horizontal cracks in the upper portion 25 of the cast concrete pile 26 while the vertical straight hollow tubes 22 containing the demolition-facilitating substance serve to produce generally vertical cracks in the upper portion 25 of the concrete pile 26.

For installing the cast-in-place concrete pile 26, a vertical hole is first bored in the ground, and a cylindrical shell 28 is inserted into the hole. Then, the reinforcement 29 of a latticework composed of steel bars 29*a* is placed in the cylindrical shell 28. Tubes made, for example, of vinyl are fitted on the upper portions of the reinforcement bars 29*a* disposed above the demolition plane 24, thereby ensuring that the concrete will not adhere to the upper portions of the reinforcement bars 29*a*.

Special S-mite powder mentioned above is mixed with water to form a slurry which serves as the demolition-facilitating substance. The demolition-facilitating substance is filled in the hollow tubes 21*a*,21*b*,22 each having one end closed by a suitable closure member such as a cap. Then, the other ends of the hollow tubes are closed by such closure members. The Special S-mite is so adjusted that it is cured in about 15 minutes. Then, the horizontal and vertical hollow tubes 21*a*,21*b*,22 are secured to the bars 29*a* of the reinforcement 29 in the manner mentioned above. The lower horizontal hollow tubes 21*a* are spaced upwardly from the demolition plane 24 a predetermined distance, i.e., about 30 to 40 cm, so that generally horizontal cracks to be produced by the expansion of the demolition-facilitating substance in the lower hollow tubes will not extend below the demolition plane 24.

Then, the reinforcement 29 to which the hollow tubes 21*a*,21*b*,22 are attached is placed in position in the cylindrical shell 28, using a crane. Then, concrete is poured in the shell 28 through the tremie pipe to cast the concrete pile 26. The shell 28 is withdrawn from the ground immediately after the concrete is filled in the shell 28. Then, the concrete filled in the hole in the ground is cured so that the cast concrete pile 26 comes to have a sufficient strength. During the curing of the concrete, the demolition-facilitating substance in the hollow tubes 21*a*,21*b*,22 is gradually expanded to apply an increasing pressure to the hollow tubes 21*a*,21*b*,22. The demolition-facilitating substance in the hollow tubes is finally expanded to a predetermined level generally simultaneously when the cast concrete pile 26 is completely cured, so that the demolition-facilitating substance ruptures the hollow tubes 21*a*,21*b*,22 and produces horizontal and vertical cracks in the upper end 25 of the concrete pile 26 above the demolition plane 24, thereby demolishing the upper portion 25 in a quiet manner. After the concrete pile 26 is cured, the ground around the concrete pile 26 is excavated to inspect the generation of the cracks in the upper end 25 above the demolition plane 24. Then, the upper end 25 is easily removed or destroyed by a suitable means such as a hammer and a breaker.

Figure 6:
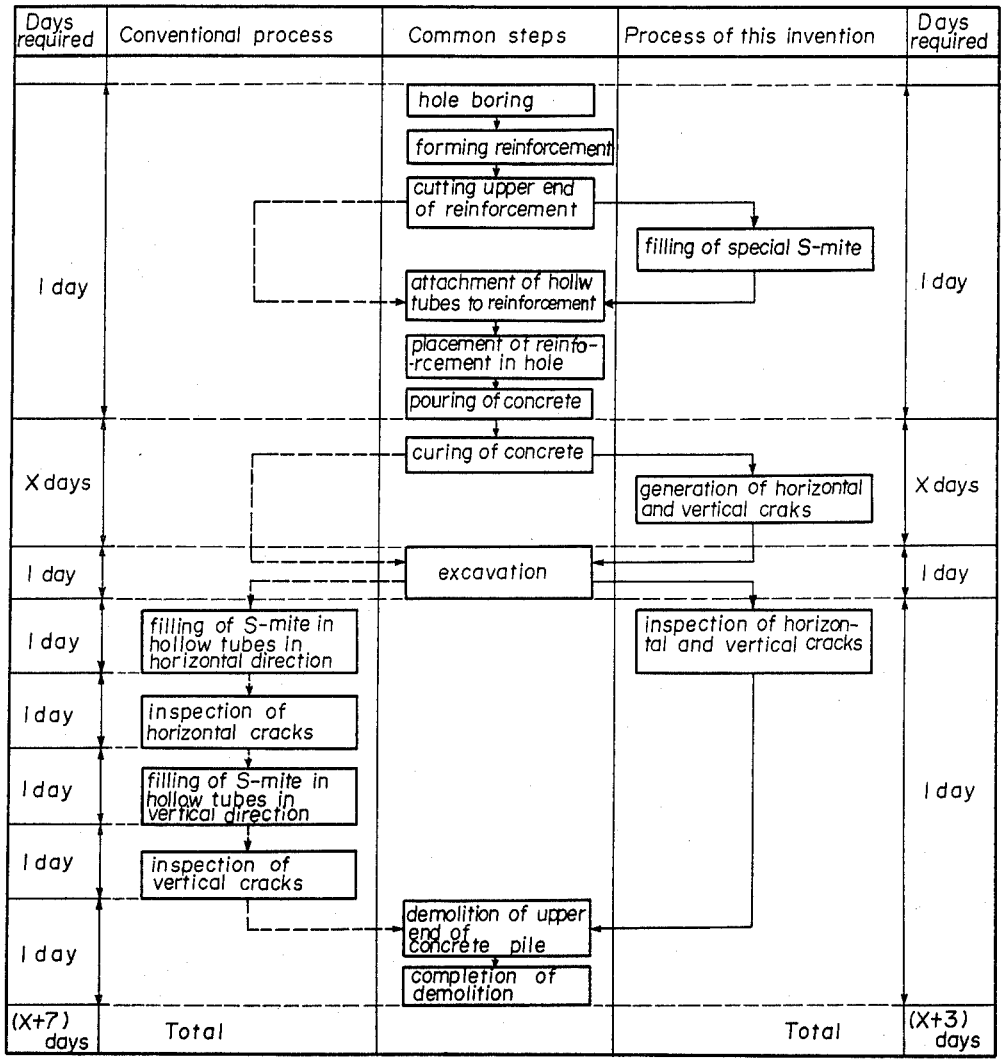
FIG. 6 is a flow chart showing the process of the conventional pile forming method and the process of the pile forming method according to the present invention.

FIG. 6 shows a flow chart showing the process of producing the concrete pile 26 in accordance with the invention and the conventional pile forming process.

As shown in FIG. 6, the Special S-mite serving as the demolition-facilitating substance is expanded to the predetermined level generally when the curing of the concrete pile 26 is completed to cause the pile to have a sufficient strength. Therefore, the demolition of the upper end 25 of the concrete pile 26 above the demolition plane 24 can be smoothly effected generally simultaneously with the completion of the curing of the cast concrete pile 26. Therefore, the period of the installation of the concrete pile 26 can be reduced substantially, i.e., four days (FIG. 6), in comparison with the conventional process.

The expansion of the demolition-facilitating substance (Special S-mite) is controlled by either varying the amount of the retarder or changing the kind of the retarder. Thus, the expansion of the demolition-facilitating substance to the above-mentioned predetermined level can coincide with the generation of the strength of the concrete pile 26. Also, the amount of the retarder added to the demolition-facilitating substance may be so adjusted that the cracks develop in the concrete pile 26 gradually during the curing of the concrete pile 26.

While the method of forming the cast-in-place concrete pile according to this invention has been specifically shown and described herein, the invention itself is not to be restricted by the exact showing of the drawings or description thereof.

For example, the lower horizontal hollow tubes 21*a* may have a larger diameter to hold a greater amount of the demolition-facilitating substance so that the horizontal cracks are first produced in the upper portion 25 of the concrete pile 26, thereby ensuring that the vertical cracks will not extend below the demolition plane 24. Also, the vertical hollow tubes 22 may be first attached to the reinforcement 29 before the reinforcement 29 is placed in the shell 28, so that the demolition-facilitating substance is filled in the vertical tubes 22 after the reinforcement 29 is placed in the shell 28. Further, the demolition-facilitating substance may be embedded in the concrete pile 26 without the use of the hollow tubes 21*a*,21*b*,22. In this case, the demolition-facilitating substance is molded into a structure or skeleton of a predetermined shape resembling the tube structure 20.

The hollow sheathed tubes may be replaced by any other suitable containers capable of holding the demolition-facilitating substance in the form of a slurry. The hollow tubes 21*a*,21*b*,22 may be made of metal other than steel such as aluminum, a synthetic resin such as vinyl chloride, rubber, or paper.

Although Special S-mite is used as the demolition-facilitating substance in this embodiment, any other suitable expansive agent or demolition-facilitating agent such as Blister (tradename) manufactured by Onoda Semento Kabushiki Kaisha (Japan), calcia clinker, coal-based expansive agent and calcium sulfoalminate can be used.

As described above, according to the present invention, the demolition of the upper portion of the concrete pile can be effected generally simultaneously when the curing of the concrete pile is completed. In addition, the demolition-facilitating substance can be applied at a time before concrete is poured into the shell, and therefore does not need to be applied separately at several stages as is the case with the conventional method.

Therefore, the concrete pile forming method according to the present invention requires less time and labor and is desirable from an economical point of view.

What is claimed is:

1. A method of forming a cast-in-place concrete pile which comprises the steps of:

(a) mounting a plurality of tubes filled with a demolition-facilitating substance in an open top confined space above a predetermined level, said demolition-facilitating substance being in the form of a slurry; and (b) subsequently pouring concrete into said confined space to cover said tubes to cast a concrete pile, so that said demolition-facilitating substance being adjusted in such a manner that said demolition-facilitating substance is caused to expand to rupture said tubes to produce cracks in the concrete pile above said predetermined level generally when the curing of said concrete is completed.

2. A method according to claim 1, in which before the step of mounting said demolition-facilitating substance, a reinforcement of a latticework is placed in said confined space, said tubes being mounted on said reinforcement.

3. A method according to claim 1, in which some of said tubes are disposed horizontally while other tubes are disposed vertically.

* * * * *